United States Patent [19]

Minks

[11] 4,061,994

[45] Dec. 6, 1977

[54] MINIATURE RELAY WITH BEARING SUPPORTS ASSOCIATED WITH THE HOUSING

[75] Inventor: Werner Minks, Reime-Siedlung, Germany

[73] Assignee: International Standard Electric Corporation, New York, N.Y.

[21] Appl. No.: 675,157

[22] Filed: Apr. 8, 1976

[30] Foreign Application Priority Data

Apr. 15, 1975 Germany ..... 2516502

[51] Int. Cl.[2] ..... H01H 9/02

[52] U.S. Cl. ..... 335/202; 335/270; 335/278

[58] Field of Search ..... 335/128, 202, 270, 274, 335/276, 278

[56] References Cited

U.S. PATENT DOCUMENTS

| | | | |
|---|---|---|---|
| 3,365,683 | 1/1968 | Aidn et al. | 335/274 |
| 3,643,186 | 2/1972 | Fischer | 335/276 X |
| 3,836,878 | 9/1974 | Minks | 335/128 |

FOREIGN PATENT DOCUMENTS

| | | | |
|---|---|---|---|
| 1,155,537 | 10/1963 | Germany | 335/276 |
| 1,359,124 | 7/1974 | United Kingdom | 335/128 |

*Primary Examiner*—George Harris
*Attorney, Agent, or Firm*—William T. O'Neil

[57] ABSTRACT

A relay structure especially for miniature relays in which the armature part is held in place with respect to the electromagnet by means of shoulder pieces projecting within the relay housing. The housing and shoulder pieces may be made of a thermally softenable material, such as a "thermoplastic," so that the assembly may be heated and mechanically deformed to adjust clearances as a part of the final assembly process. Two versions of a flap or leaf spring for extra retention of the armature part are shown.

13 Claims, 4 Drawing Figures

MINIATURE RELAY WITH BEARING SUPPORTS ASSOCIATED WITH THE HOUSING

BACKGROUND OF THE INVENTION

1. Field of the Invention

The present invention relates to relays generally and more specifically, to miniature relays the moving parts of which are supported from within the relay housing.

2. Description of the Prior Art

Miniature relays employing various magnet arrangements are known, for example, from German Published Patent Application Nos. 1,292,752 and 2,253,456. German Petty Pat. No. 7,122,599 shows a relay in which the contact spring also provides a lifting force in cooperation with a clip on the yoke. In these prior art configurations, however, an unsolved problem remains in respect to retention of the loosely inserted parts of the magnet system inside a casing. It is particularly important that a defined reproducible position of the parts in relation to one be provided to insure satisfactory and reliable functioning of such relays. None of this prior art satisfactorily addresses the approach to low cost, easy manufacture of a relay afforded by the present invention.

The manner in which the present invention deals with prior art problems will be evident as this description proceeds.

SUMMARY OF THE INVENTION

It may be said to have been the general objective of the present invention to provide a structure in which the parts of both the magnet and the switch system assume a well-defined position in relation to one another with the aid of simple means.

The relay, according to the invention, consists of a minimum number of parts capable of being assembled in a simple way without requiring any further adjustment. Owing to miniaturization, there is still to be solved the additional problem of effectively actuating a small armature in relation to a small yoke.

In a miniature relay of the type mentioned hereinbefore, the desired results are achieved in that shoulders are provided inside the housing for retaining in position the parts of the magnet system and for restricting the freedom of movement of the tilting armature in relation to the yoke. In an advantageous manner, these shoulders may be designed in such a way that various parts can be used for performing different functions, for example, a standard part may be used to support the armature, and in another location for supporting the yoke. The shoulders may be designed as different kinds of bosses or projections inside the housing which may also be combined to form one piece.

It is also advantageous to form the housing of two half shells inside which the shoulders are arranged symmetrically. The halves of the housing are designed mirror-symmetrically and therefore, may be identical parts.

As a further advantageous feature, a resilient flap or leaf spring may be incorporated for further restricting the freedom of movement of the tilting armature in direction toward the quiescent position within the area of clearance between the shoulders.

Still further, adjustment of operative clearances and limits can be achieved by thermal deformation carried out after assembly of the magnet system in the housing.

Advantages and structural variations of the invention will be explained with reference to examples illustrated in FIGS. 1 through 4 of the accompanying drawings.

DESCRIPTION OF THE PREFERRED EMBODIMENT

Figure 1:
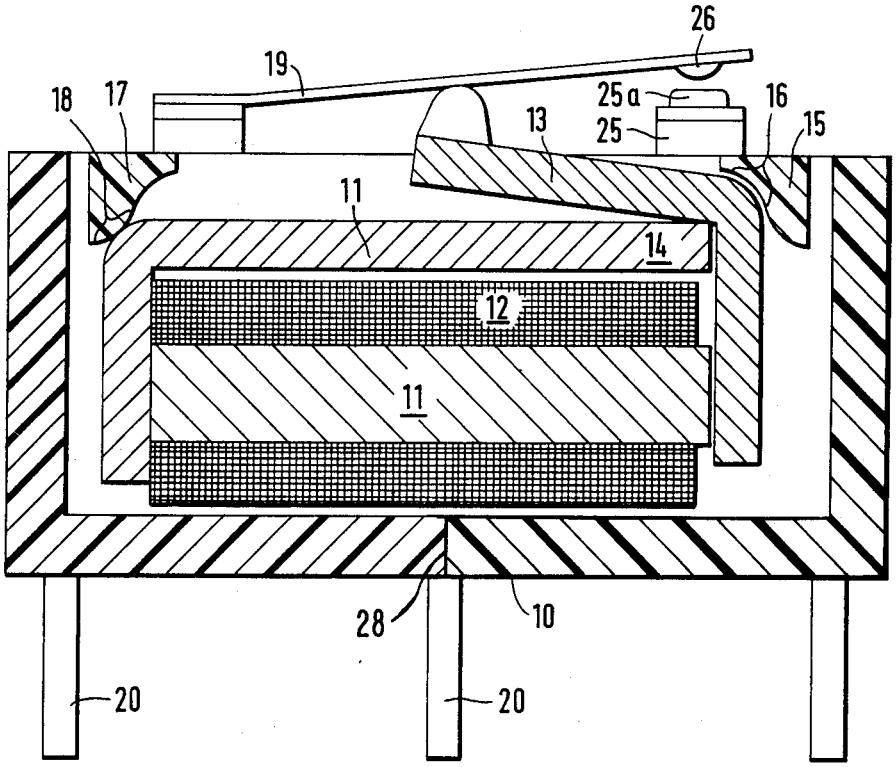
FIG. 1 is a sectional view, showing the construction, according to the invention, of a miniature relay built into a housing.

In FIG. 1, a miniature relay is assembled in a housing 10. The relay magnetic actuation components (electromagnet) include yoke 11 with a coil winding 12. The yoke 11 actually includes a central core and a wrap-around yoke piece of magnetic material as shown, generally referred to as simply a yoke. On the right side as drawn, the yoke is opened in a U-shaped fashion, and thereon a tilting armature 13 is supported which, upon actuation, is drawn to the free yoke ends of the yoke to complete the magnetic circuit and, simultaneously, actuates a contact leaf spring member 19. A lever arm portion of 13 arranged freely over the yoke engages 19 for this purpose. Both the contacts and the coil terminals may be brought out, typically by plug-in pins 20 on the bottom side of the housing.

The interior vertex of the L-shaped tilting armature 13 is rotatable about a yoke edge 14 serving as the axis (pivotal point) of rotary (tilting) movement. On the outside opposite 14 and the armature vertex, the tilting armature 13 is provided with a rounded convex surface in the area of 16. During movement of the tilting armature 13, this convex armature surface moves along a circular track against support and alignment member 15. Both the yoke 11 with its coil 12 and armature 13 must be allowed some movability which, however, must occur repeatably with respect to the initial position.

With respect to translational movement of the yoke 11 in response to movement of the tilting armature 13, shoulders 15 and 17 are provided inside the housing 10 according to the invention. The shoulder 15 is provided with a concave surface curvature 16 corresponding to the outside convex curvature of the tilting armature 13, thus resisting the movement of 13 as little as possible. In view of the convex supporting edge 18 of the shoulder 17 effective in one area, the magnet system is only capable of moving within a narrow range of clearance, however, what movement of the tilting armature 13 and the yoke 11 does occur, occurs contemporaneously.

Owing to the fact that the paths of the relative movements of both the tilting armature 13 and the yoke 11 do not necessarily occur in the same direction, the tilting armature is always positioned in a comparatively different initial position, the weight of the magnet system parts being insufficient to establish a definite initial position.

As is shown in FIG. 1, the shoulders 15 and 17 may be in fact, the same part. At 17, a different part 18 of the curvatures 16 and 18 is employed vis-a-vis that used at 15. A symmetrical construction of the shoulders is possible and advantageous, further because the housing may likewise consist of symmetrical (even identical) half-shell shaped parts.

Accordingly, for manufacturing miniature relays according to the invention, a single housing part (half shell) may be fabricated with the corresponding shoulders integral therein. These parts are readily produced, as for example, by injection moulding. Two such parts are simply assembled to form one relay housing with the yoke, coil and armature loosely placed therein. Joining of the housing halves may be effected by well known methods, as at the line of joining 28 in FIG. 1. While this two-piece form of the housing is shown in the FIG. 1 embodiment, the alternative one-piece housing is illustrated in the embodiment of FIG. 3.

Figure 2:
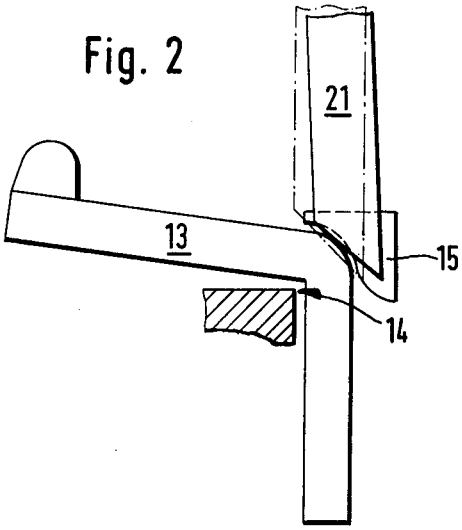
FIG. 2 shows a particular type of tilting armature retaining arrangement for use in the device of FIG. 1.

As a further advantage of the invention, it has proved advantageous to form a flap 21 for additionally pressing the tilting armature 13 against its bearing edge at 14 (See FIG. 2). This flap is in such a way pre-tensioned (biased) that it, without the armature, would come to lie in the position as indicated by the dot and dash lines shown in FIG. 2. In this way it is possible to take into account the necessary freedom of movement of the tilting armature which is required for every actuation. After each actuation, the tilting armature 13 is returned repeatably by the resilient flap 21 to a predetermined normal position. The flap 21 may be attached to one part of the housing or to an additional cover member, and may consist of a resilient plastic material.

Figure 3:
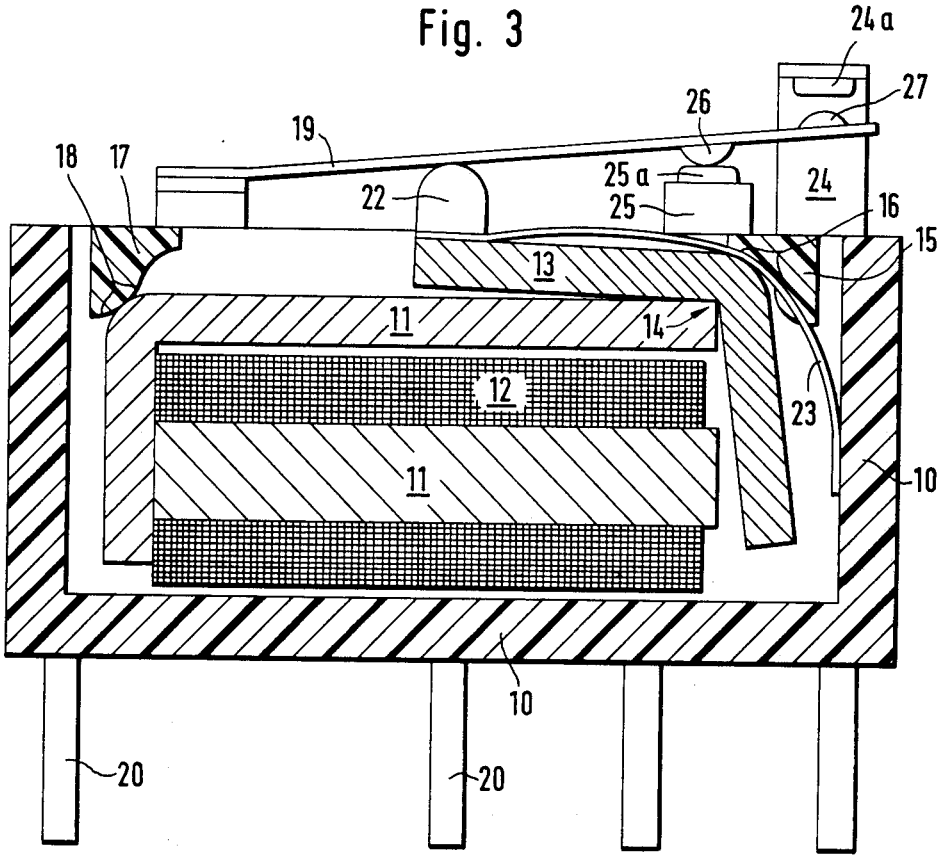
FIG. 3 is a sectional view of a relay of the double-throw type including an alternate form of resilient means for biasing the armature into one of the two positions.

Referring now to FIG. 3, the double-throw relay illustrated employs substantially the same basic parts as in the relay of FIG. 1, including the coil 12, yoke 11, case 10, shoulder 15 and 17, armature 13 and contact spring arm 19. In addition, FIG. 3 includes contact mounting 24 with contact **24*a* thereon. To accommodate additional moving contact 27, the leaf spring arm 19 is somewhat elongated as compared to FIG. 1, the latter having only the single fixed contact 25*a* on contact mount 25, opposite moving contact 26**.

The configuration of FIG. 3 significantly enhances the reproducibility of the desirable switching characteristics and location of the components.

The tilting armature 13 operates against the bearing point 14 on the yoke 11 in essentially the same manner as in FIG. 1. In FIG. 3, however, a leaf spring 23 is provided. Spring 23 rests against the inside of the housing 10 as shown and is connected (by any of the known techniques) to the arm of 13 at or near its end which supports the insulating actuating (plunger) member 22.

Since the inherent resilience of spring 23 is such as to exert a force tending to straighten itself, there is an inherent force tending to keep the plunger (actuator) 22 in touch with 19, but this force is small compared to the spring action of 19 holding **25*a* and 26** together.

The entire relay assembly of FIG. 3 is constructed in such a way that armature 13 can be positioned loosely inside casing 10 together with the electromagnet subassembly. The positions of the parts are then secured by 23, which tends to retain itself against the inside of housing 10, to exert a force just sufficient to keep the actuating member (plunger) in contact with contact spring 19, and finally to retain the armature in contact with point 14 of the yoke.

It should be emphasized that the force of 23, keeping 22 in contact with 19 in the quiescent position is not sufficient to disturb the contact between **25*a* and 26 (as illustrated in FIG. 3**).

When the coil 12 is energized, the armature 13 is drawn into a magnetic circuit closure position (as illustrated in FIG. 1), against the forces of 19 and 23, the latter being relatively small compared to the armature return action provided by 19 when coil 12 is deenergized. It will be noted that in the condition of coil 12 energization, contact is effected between **24*a* and 27 of FIG. 3**.

The spring 23 considerably improves the performance of the relay in shock and vibration environments, thus resulting in increased stability of the magnetic attracting forces and, consequently, of the overall electrical performance of the relay.

Figure 4:
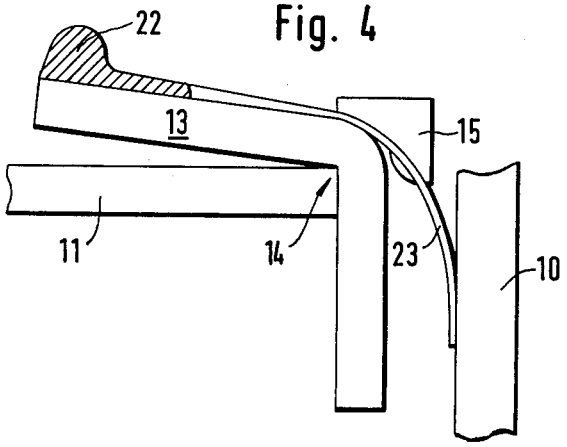
FIG. 4 is a detail of a variation in the structure of the resilient means of FIG. 3.

The spring 23 can be made of a well known spring metal, or of an electrically and magnetically non-conducting material, since it has only to perform mechanical functions. Moreover, it is conceivable for the spring to be shaped integrally as a part of the casing itself, it being then applied to the swivel armature or attached thereto. Likewise, it is possible for the spring 23 to be shaped integrally with actuating plunger 22, and mounted together with the actuating plunger to the swivel armature 13, as is shown in FIG. 4. Such expedients provide that, in assembling the relay into the casing, there would not be any additional loose part. According to FIG. 4, the spring 23 is preshaped to the armature 13, and is therefore readily built in without requiring any further auxiliary means. The spring material itself may in fact be of plastic foil.

Still further, and especially with reference to FIG. 1, it is also possible to achieve the desired freedom of movement and clearance of both the yoke 11 and the armature 13 in the built-in condition by thermally deforming the entire system while it is being actuated (cycled) and the performance monitored. In this way curved bearing surfaces or indentations are automatically formed or modified on the supporting surfaces of 15 and 17. Normally, if the aforementioned thermal deformation process is to be employed, at least the parts 15 and 17 would be (preferably) made of a thermoplastic material. The housing half shells may also be of such material, especially if they are formed with integral members 15 and 17. The member 19 is of course made of conductive resilient material and the yoke parts must be of a magnetic flux-transmissive material of low retentivity.

What is claimed is:

1. A relay structure comprising:

an electromagnet assembly including a coil about a generally central axial magnetic core piece and a yoke piece providing a pair of magnetic poles at a first end of said electromagnet assembly in the form of the generally flat ends of said yoke and core pieces, said yoke piece having an outer edge at said first end, and further being magnetically connected to said core at the second end of said electromagnet assembly;

a generally L-shaped armature piece placed at said first end with the vertex of its obtuse interior angle in contact with said yoke piece outer edge, a first leg of said armature being located so as to be magnetically pulled to said core piece thereby tilting said armature about said vertex;

a housing containing said electromagnet assembly and said armature piece;

and means comprising a pair of shoulder pieces located within said housing, one of said shoulder pieces bearing against the outside surface of said armature opposite said vertex and the other bearing against said yoke adjacent said second end, thereby to provide axial constraint for the assembly comprising said electromagnet assembly and said armature, and preservation of the relative axial positions of said yoke and said armature.

2. Apparatus according to claim 1 in which said armature has a convex curved shape along said outside surface thereof opposite said vertex and in which said shoulder piece bearing against said convex armature surface is shaped according to a concave contour matching said convex shape.

3. Apparatus according to claim 2 in which said housing comprises two shell parts joinable at a point between the axial extremities of said electromagnet assembly contained therein, and in which said shoulder pieces are integrally moulded into said shell parts, said axial constraint being provided for said electromagnet and armature assembly when said shell parts are joined.

4. Apparatus according to claim 2 in which said shoulder pieces are identical in construction, are generally wedge-shaped in the lateral plane with two mutually normal sides and a third side contoured to be generally convex over a first portion of its length and generally concave over the remainder of its length in said lateral plane, the one of said shoulder pieces bearing against said yoke at said second end of said electromagnet assembly being mounted on the inside surface of said housing such that the convex surface formed on said shoulder piece is adjacent said second electromagnet end, and the one of said shoulder pieces adjacent said electromagnet first end is mounted on the inside surface of said housing such that said concave surface formed on said shoulder piece is adjacent said armature outside surface.

5. Apparatus according to claim 1 further defined in that a resilient flap is included, said flap being anchored from said housing and arranged to apply a resilient force against said armature in the same general area as the area of adjacency of said shoulder piece at said armature to mechanically bias said electromagnet assembly at least axially within said housing.

6. Apparatus according to claim 1, further defined in that said relay structure includes a relatively flat, elongated, contact spring carrying at least one movable electrical contact, at least one fixed contact arranged to be engaged by said one electrical contact, said contact spring being arranged to assume either of first and second positions corresponding to first and second patterns of engagement of said movable electrical contact with said fixed contact, and actuation means attached to the second leg of said armature for deflecting said contact spring to said second position when said first leg is magnetically pulled to said core piece, and in which a leaf spring is included, said leaf spring being placed to exert a first force tending to keep said armature in contact with said yoke piece outer edge and also to provide a second force tending to keep said actuation means in contact with said contact spring when said contact spring is in said first position.

7. Apparatus according to claim 6 in which said leaf spring is attached to said armature second leg.

8. Apparatus according to claim 7 in which said leaf spring is emplaced over the outside surface of said armature at least in the area opposite said vertex and said leaf spring bears against the inside of said housing at a point of bearing opposite said armature first leg.

9. Apparatus according to claim 8 in which said leaf spring is formed of a resilient, non-conducting material which is not magnetic flux transmissive.

10. Apparatus according to claim 8 in which said actuator means comprises a plunger-like projection of insulating material and said leaf spring is integrally formed therewith such that both may be simultaneously affixed to said armature second leg.

11. Apparatus according to claim 9 in which said actuator means comprises a plunger-like projection of insulating material and said leaf spring is integrally formed therewith such that both may be simultaneously affixed to said armature second leg.

12. Apparatus according to claim 8 in which said leaf spring is integrally formed with the wall of said housing at said point of bearing.

13. Apparatus according to claim 1 in which at least said housing is fabricated of a material which is deformable when heated, the temperature threshold of deformability is below the temperature at which other components of said relay would be damaged, thereby to facilitate adjustment of clearances between said shoulder pieces and the parts of said electromagnet assembly.

* * * * *